US007495685B2

(12) United States Patent
Takasaka et al.

(10) Patent No.: US 7,495,685 B2
(45) Date of Patent: Feb. 24, 2009

(54) IMAGE GENERATING APPARATUS

(75) Inventors: Daisuke Takasaka, Daito (JP); Masaki Nakatani, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 281 days.

(21) Appl. No.: 11/431,027

(22) Filed: May 10, 2006

(65) Prior Publication Data

US 2006/0274143 A1 Dec. 7, 2006

(30) Foreign Application Priority Data

Jun. 6, 2005 (JP) ..... 2005-165079

(51) Int. Cl.
*B41J 25/304* (2006.01)

(52) U.S. Cl. ..... 347/197; 400/120.16

(58) Field of Classification Search ..... 347/197; 400/120.16

See application file for complete search history.

(56) References Cited

U.S. PATENT DOCUMENTS 4,879,566 A 11/1989 Hanabusa
7,073,962 B2 * 7/2006 Sawai ..... 400/120.01
7,081,911 B2 * 7/2006 Sawai ..... 347/197
7,286,151 B2 * 10/2007 Sawai ..... 347/197
2004/0144267 A1 7/2004 Maruyama et al.
2005/0062834 A1 3/2005 Sawai

FOREIGN PATENT DOCUMENTS

JP 6-122246 A 5/1994
JP 9-1888027 A 7/1997
JP 2863394 B2 12/1998
JP 2915710 B2 4/1999
JP 3100225 B2 8/2000

OTHER PUBLICATIONS

European Search Report dated May 28, 2008 (Eight (8) pages).

* cited by examiner

*Primary Examiner*—Huan H Tran
(74) *Attorney, Agent, or Firm*—Crowell & Moring LLP

(57) ABSTRACT

A downsizable image generating apparatus capable of reducing the number of components is obtained. This thermal transfer printer (image generating apparatus) comprises a drive gear arranged on a first end of a support rod for rotating a head portion by transmitting driving force of a motor to a head portion pressing member. The head portion pressing member is provided with a gear portion meshing with the drive gear and a protrusion. The head portion is provided with a notch engaging with the protrusion of the head portion pressing member upon upward rotation of the head portion pressing member.

17 Claims, 7 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a print head.

2. Description of the Background Art

A thermal printer (thermal transfer printer) is generally known as an image generating apparatus performing printing by pressing a print head against a platen provided in the form of a roll or the like. For example, Japanese Patent Laying-Open No. 6-122246 (1994) discloses such a thermal printer (thermal transfer printer).

The aforementioned Japanese Patent Laying-Open No. 6-122246 discloses a thermal printer pressing a print head against a platen roller by urging the printing head portion downward with a spring.

However, the conventional thermal printer disclosed in the aforementioned Japanese Patent Laying-Open No. 6-122246 is provided with no mechanical portion for automatically separating the print head from the platen roller, and hence it is disadvantageously necessary to manually lift up the print head, in order to separate the same from the platen roller.

In this regard, a print head printer provided with a mechanical portion for automatically separating a print head from a printer is proposed in general, as disclosed in Japanese Patent Laying-Open No. 5-309905 (1993), Japanese Patent Laying-Open No. 6-15852 (1994), Japanese Patent Laying-Open No. 6-191066 (1994) or Japanese Patent Laying-Open No. 9-188027 (1997), for example.

The aforementioned Japanese Patent Laying-Open No. 5-309905 discloses a print head, pressed against a platen with urging force of a spring, provided with a mechanical portion (head portion retraction means) formed by a gear wheel, a follower plate and an arm for moving the print head oppositely to the platen against the urging force of the spring.

Each of the aforementioned Japanese Patent Laying-Open No. 6-15852, Japanese Patent Laying-Open No. 6-191066 and Japanese Patent Laying-Open No. 9-188027 discloses a thermal printer, having a print head mounted on an arm synchronously rotating with a cam, capable of pressing and separating the print head against and from a platen roller by rotating the cam thereby rotating the arm. In this thermal printer, coupling arms coupling a support shaft rotatably supporting the print head and the print head with each other are provided on both ends of the print head for rotating the print head about the support shaft by engaging the coupling arms with the arm synchronously rotating with the cam.

In the conventional thermal printer disclosed in the aforementioned Japanese Patent Laying-Open No. 5-309905, however, the number of components is disadvantageously increased due to the mechanical portion (head portion retraction means) formed by the gear wheel, the follower plate and the arm separately provided for moving the print head oppositely to the platen in order to separate the print head from the platen.

In the conventional thermal printer having the print head mounted on the arm synchronously rotating with the cam disclosed in each of the aforementioned Japanese Patent Laying-Open No. 6-15852, Japanese Patent Laying-Open No. 6-191066 and Japanese Patent Laying-Open No. 9-188027, the arm presses only one of the coupling arms of the print head and applies pressing force to only the corresponding end of the print head if the thermal printer has only a single cam since the arm engaging with the cam engages with the coupling arms, and hence the print head cannot be uniformly pressed against the platen roller. In order to uniformly press the print head against the platen roller, therefore, two cams must be provided on both ends of the print head for pressing both ends of a coupling portion of the print head. More specifically, the cams must be arranged on both ends of the print head, and arms synchronously rotating with the cams must also be provided on both ends of the print head. Consequently, the number of components is disadvantageously increased in the conventional thermal printer disclosed in each of the aforementioned Japanese Patent Laying-Open No. 6-15852, Japanese Patent Laying-Open No. 6-191066 and Japanese Patent Laying-Open No. 9-188027, although the print head can be automatically separated from the platen roller. Further, the size of the thermal printer is disadvantageously increased due to the cams arranged on both ends of the print head.

SUMMARY OF THE INVENTION

The present invention has been proposed in order to solve the aforementioned problems, and an object of the present invention is to provide a downsizable image generating apparatus capable of reducing the number of components.

An image generating apparatus according to a first aspect of the present invention comprises a platen roller, a print head, opposed to the platen roller, having a head portion pressed against the platen roller, a head portion pressing member provided independently of the print head and mounted on a rotary shaft for pressing the head portion of the print head against the platen roller and a gear arranged on a first end of the rotary shaft for rotating the head portion, while the head portion pressing member is provided with a gear portion meshing with the gear and a first engaging portion, and the head portion is provided with a second engaging portion engaging with the first engaging portion of the head portion pressing member upon upward rotation of the head portion pressing member.

In the image generating apparatus according to the first aspect, as hereinabove described, the gear for rotating the head portion pressing member mounted on the rotary shaft by transmitting driving force from a drive source thereto is arranged on the first end of the rotary shaft while the gear portion meshing with the gear is formed on the head portion pressing member so that the driving force can be transmitted from the drive source to the head portion pressing member through the gear, whereby the upper portion of the print head can be pressed with the head portion pressing member by rotating the head portion pressing member through the rotary shaft. When the head portion pressing member is arranged on a position uniformizing pressing force against the print head, therefore, the print head can be uniformly pressed against the platen roller with the head portion pressing member through the rotary shaft with the gear arranged on the first end of the rotary shaft, whereby the image generating apparatus can be inhibited from applying nonuniform pressing force against the print head although the gear is not arranged on each end of the rotary shaft. Thus, the gear for rotating the head portion pressing member may not be arranged on each side of the rotary shaft, whereby the number of components can be reduced. Further, the head portion pressing member is provided with the first engaging portion and the head portion of the print head is provided with the second engaging portion engaging with the first engaging portion of the head portion pressing member upon upward rotation of the head portion pressing member so that the head portion of the print head can be rotated upward by engaging the second engaging portion mounted on the head portion of the print head and the first engaging portion of the head portion pressing member with each other upon upward rotation of the head portion pressing member, whereby the head portion of the print head can be separated from the platen roller by upwardly rotating the head portion pressing member. Therefore, no mechanical portion may be additionally provided for separating the head portion of the print head from the platen roller, whereby the number of components can be reduced also according to this structure. In addition, the gear for rotating the head portion pressing member mounted on the rotary shaft may not be arranged on each end of the rotary shaft and no mechanical portion may be additionally provided for separating the head portion of the print head from the platen roller, whereby the image generating apparatus can be downsized.

In the aforementioned image generating apparatus according to the first aspect, the print head preferably includes a spring fixing member, mounted on the head portion, having a first spring fixing portion and a second spring fixing portion arranged in the axial direction of the platen roller at a prescribed interval as well as a first spring member and a second spring member fixed to the first spring fixing portion and the second spring fixing portion of the spring fixing member respectively for urging the head portion toward the platen roller, and the head portion pressing member preferably includes a first head portion pressing member for generating urging force in the spring member by pressing the first spring member through rotation following driving of the gear and a second head portion pressing member for generating urging force in the second spring member by pressing the second spring member through corotation with the first head portion pressing member. According to this structure, the print head can be urged toward the platen roller with the first and second spring members, whereby the head portion of the print head can be stably pressed against the platen roller as compared with a case of urging the head portion of the print head toward the platen roller with urging force of a single spring member.

In the aforementioned image generating apparatus according to the first aspect, the first head portion pressing member is preferably integrally provided with the gear portion meshing with the gear. According to this structure, the number of components can be inhibited from increase despite the gear portion provided on the first head portion pressing member.

In the aforementioned image generating apparatus comprising the head portion pressing member including the first and second head portion pressing members and the spring fixing member having the first and second spring fixing portions, the first engaging portion is preferably provided on either the first head portion pressing member or the second head portion pressing member, and the second engaging portion is preferably provided on either the first spring fixing portion or the second spring fixing portion corresponding to the first or second head portion pressing member provided with the first engaging portion. According to this structure, the head portion of the print head can be easily rotated following rotation of the head portion pressing member by engaging the first and second engaging portions with each other.

In the aforementioned image generating apparatus according to the first aspect, the first engaging portion preferably includes a protrusion integrally provided on the second head portion to protrude in the extensional direction of the rotary shaft, and the second engaging portion preferably includes a notch integrally provided on the second spring fixing portion of the spring fixing member for engaging with the protrusion of the second head portion pressing member upon upward rotation of the second head portion pressing member. According to this structure, the number of components can be inhibited from increase despite the first and second engaging portions formed by the protrusion and the notch respectively provided on the second head portion pressing member and the second spring fixing portion of the spring fixing member respectively.

In this case, the second spring fixing portion preferably includes an upright wall formed by partially uprighting the spring fixing member formed by a plate body, and the notch is preferably formed on the upright wall. According to this structure, the upright wall having the notch can be easily integrally formed on the second spring fixing portion by partially uprighting the spring fixing member formed by a plate body.

In the aforementioned structure including the notch, a chamfer is preferably formed on the opening side of the notch. According to this structure, the opening space of the notch is increased on the opening side, whereby the protrusion of the second head portion pressing member can be easily engaged with the notch.

In the aforementioned image generating apparatus comprising the head portion pressing member including the first and second head portion pressing members and the spring fixing member having the first and second spring members, the first head portion pressing member and the second head portion pressing member preferably press the first spring member and the second spring member respectively while the engagement between the first engaging portion and the second engaging portion is canceled. According to this structure, the operation of the first engaging portion of the second head portion pressing member is not restrained by the second engaging portion of the second spring member when the first and second head portion pressing members press the first and second spring members respectively, whereby the first and second spring members can be easily pressed with the first and second head portion pressing members respectively.

In the aforementioned image generating apparatus comprising the spring fixing member having the first and second spring members, the first spring member and the second spring member may be torsion coil springs.

In the aforementioned image generating apparatus according to the first aspect, the print head preferably further includes a support shaft and an arm coupling the support shaft and the head portion with each other and is preferably rotatable about the support shaft, the head portion pressing member preferably rotates in a first direction thereby rotating the print head for pressing and moving the head portion toward the platen roller in printing, and the head portion pressing member preferably rotates in a second direction opposite to the first direction upon engagement between the first engaging portion and the second engaging portion thereby rotating the print head for separating the head portion from the platen roller in nonprinting. According to this structure, the print head can be easily rotated about the support shaft by rotating the head portion pressing member.

An image generating apparatus according to a second aspect of the present invention comprises a platen roller, a print head, opposed to the platen roller, having a head portion pressed against the platen roller, a head portion pressing member provided independently of the print head and mounted on a rotary shaft for pressing the head portion of the print head against the platen roller and a gear arranged on a first end of the rotary shaft for rotating the head portion by transmitting driving force of a motor to the head portion pressing member, the print head further includes a spring fixing member, mounted on the head portion, having a first spring fixing portion and a second spring fixing portion arranged in the axial direction of the platen roller at a prescribed interval as well as a first spring member and a second spring member fixed to the first spring fixing portion and the second spring fixing portion of the spring fixing member respectively for urging the head portion toward the platen roller, the head portion pressing member further includes a first head portion pressing member for generating urging force in the spring member by pressing the first spring member through rotation following driving of the gear and a second head portion pressing member for generating urging force in the second spring member by pressing the second spring member through corotation with the first head portion pressing member, the first head portion pressing member is integrally provided with a gear portion meshing with the gear, and the second head portion pressing member is integrally provided with a protrusion protruding in the extensional direction of the rotary shaft while the second spring fixing portion of the spring fixing member is integrally provided with a notch engaging with the protrusion of the second head portion pressing member upon upward rotation of the second head portion pressing member.

In the image generating apparatus according to the second aspect, as hereinabove described, the gear for rotating the head portion pressing member mounted on the rotary shaft by transmitting the driving force from the motor thereto is arranged on the first end of the rotary shaft while the gear portion meshing with the gear is formed on the first head portion pressing member constituting the head portion pressing member so that the driving force of the motor can be transmitted to the head portion pressing member through the gear, whereby the upper portion of the print head can be pressed with the head portion pressing member by rotating the head portion pressing member through the rotary shaft. When the head portion pressing member is arranged on a position uniformizing pressing force against the print head, therefore, the print head can be uniformly pressed against the platen roller with the head portion pressing member through the rotary shaft with the gear arranged on the first end of the rotary shaft, whereby the image generating apparatus can be inhibited from applying nonuniform pressing force against the print head although the gear is not arranged on each end of the rotary shaft. Thus, the gear for rotating the head portion pressing member may not be arranged on each side of the rotary shaft, whereby the number of components can be reduced. Further, the second head portion pressing member constituting the head portion pressing member is provided with the protrusion protruding in the extensional direction of the rotary shaft and the second spring fixing portion of the spring fixing member mounted on the head portion of the print head is provided with the notch engaging with the protrusion of the second head portion pressing member upon upward rotation of the second head portion pressing member so that the head portion of the print head can be rotated upward by engaging the notch of the second spring fixing portion of the spring fixing member mounted on the head portion of the print head and the protrusion of the second head portion pressing member with each other upon upward rotation of the head portion pressing member, whereby the head portion of the print head can be separated from the platen roller by upwardly rotating the head portion pressing member. Therefore, no mechanical portion may be additionally provided for separating the head portion of the print head from the platen roller, whereby the number of components can be reduced also according to this structure. In addition, the gear for rotating the head portion pressing member mounted on the rotary shaft may not be arranged on each end of the rotary shaft and no mechanical portion may be additionally provided for separating the head portion of the print head from the platen roller, whereby the image generating apparatus can be downsized. Further, the spring fixing member having the first and second spring fixing portions arranged in the axial direction of the platen roller at the prescribed interval is mounted on the head portion of the print head and the first and second spring members urging the head portion toward the platen roller are fixed to the first and second spring fixing portions of the spring fixing member respectively for generating urging force in the first spring member by pressing the first spring member with the first head portion pressing member rotating following driving of the gear and generating urging force in the second spring member by pressing the second spring member with the second head portion pressing member corotating with the first head portion pressing member, whereby the print head can be urged toward the platen roller with the first and second spring members. Thus, the head portion of the print head can be stably pressed against the platen roller as compared with a case of urging the head portion of the print head toward the platen roller with urging force of a single spring member. Further, the gear portion meshing with the gear is integrally provided on the first head portion pressing member, whereby the number of components can be inhibited from increase despite the gear provided on the first head portion pressing member. Further, the protrusion protruding in the extensional direction of the rotary shaft is integrally provided on the second head portion pressing member and the engaging portion engaging with the protrusion of the second head portion pressing member is integrally provided on the second spring fixing portion of the spring fixing member, whereby the number of components can be inhibited from increase despite the protrusion and the notch provided on the second head portion pressing member and the second spring fixing portion of the spring fixing member respectively. According to the present invention, the print head can be also employed for printing pictures, in addition to characters.

In the aforementioned image generating apparatus according to the second aspect, the first engaging portion is preferably provided on either the first head portion pressing member or the second head portion pressing member, and the second engaging portion is preferably provided on either the first spring fixing portion or the second spring fixing portion corresponding to the first or second head portion pressing member provided with the first engaging portion. According to this structure, the head portion of the print head can be easily rotated following rotation of the head portion pressing member by engaging the first and second engaging portions with each other.

In the aforementioned image generating apparatus according to the second aspect, the second spring fixing portion preferably includes an upright wall formed by partially uprighting the spring fixing member formed by a plate body, and the notch is preferably formed on the upright wall. According to this structure, the upright wall having the notch can be easily integrally formed on the second spring fixing portion by partially uprighting the spring fixing member formed by a plate body.

In the aforementioned image generating apparatus according to the second aspect, a chamfer is preferably formed on the opening side of the notch. According to this structure, the opening space of the notch is increased on the opening side, whereby the protrusion of the second head portion pressing member can be easily engaged with the notch.

In the aforementioned image generating apparatus according to the second aspect, the first head portion pressing member and the second head portion pressing member preferably press the first spring member and the second spring member respectively while the engagement between the first engaging portion and the second engaging portion is canceled. According to this structure, the operation of the first engaging portion of the second head portion pressing member is not restrained by the second engaging portion of the second spring member when the first and second head portion pressing members press the first and second spring members respectively, whereby the first and second spring members can be easily pressed with the first and second head portion pressing members respectively.

In the aforementioned image generating apparatus according to the second aspect, the first spring member and the second spring member may be torsion coil springs.

In the aforementioned image generating apparatus according to the second aspect, the print head preferably further includes a support shaft and an arm coupling the support shaft and the head portion with each other and is preferably rotatable about the support shaft, the head portion pressing member preferably rotates in a first direction thereby rotating the print head for pressing and moving the head portion toward the platen roller in printing, and the head portion pressing member preferably rotates in a second direction opposite to the first direction upon engagement between the first engaging portion and the second engaging portion thereby rotating the print head for separating the head portion from the platen roller in nonprinting. According to this structure, the print head can be easily rotated about the support shaft by rotating the head portion pressing member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of a thermal transfer printer according to this embodiment is described with reference to FIGS. 1 to 8. The embodiment of the present invention is applied to the thermal transfer printer, an exemplary image generating apparatus.

Figure 1:
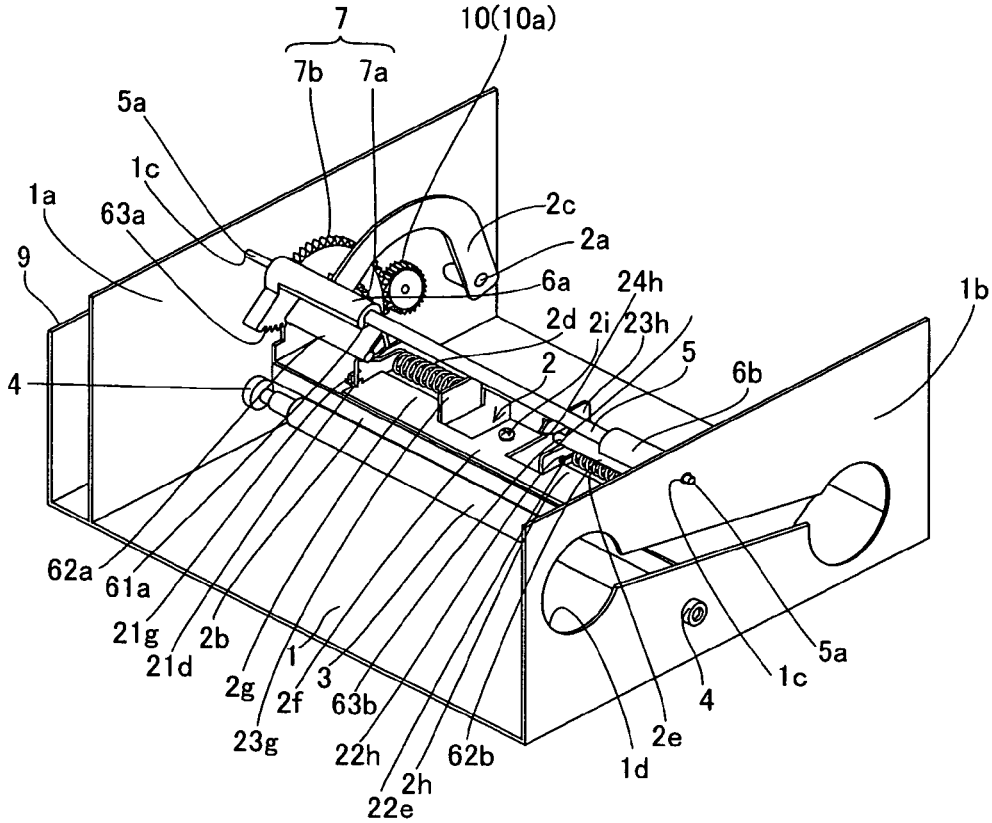
FIG. 1 is a perspective view showing the internal structure of a thermal transfer printer according to an embodiment of the present invention.
Figure 2:
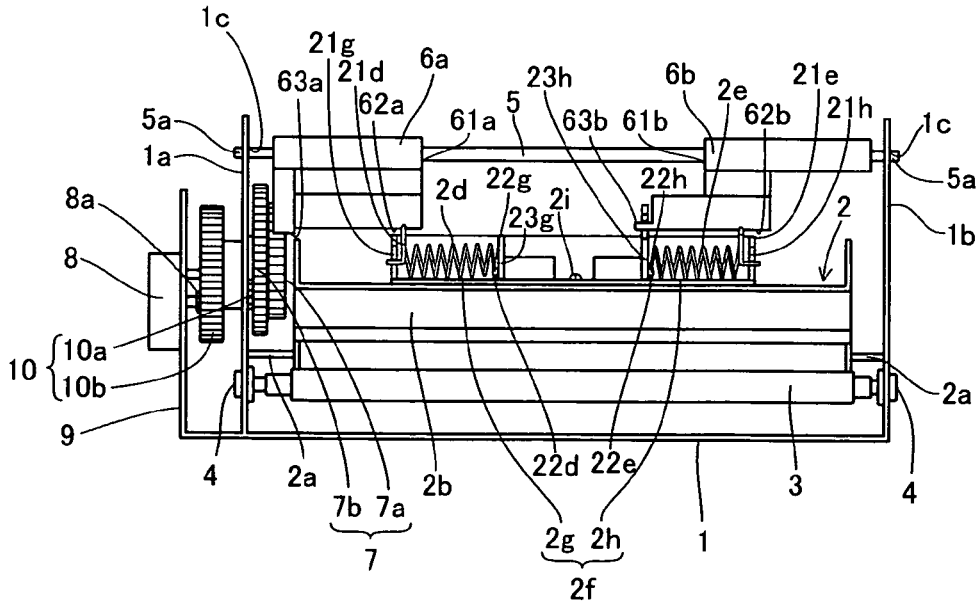
FIG. 2 is a front elevational view of the thermal transfer printer according to the embodiment shown in FIG. 1.

As shown in FIGS. 1 and 2, the thermal transfer printer according to this embodiment comprises a metal chassis 1, a print head 2 for printing, a platen roller 3, two platen roller bearings 4, a metal support rod 5, two head portion pressing members 6*a* and 6*b*, a resin drive gear 7, a motor 8 (see FIG. 2), a motor bracket 9 and an intermediate gear 10. The support rod 5 is an example of the "rotary shaft" in the present invention, and the drive gear 7 is an example of the "gear" in the present invention.

The chassis 1 has first and second side surfaces 1*a* and 1*b* opposed to each other. The first and second side surfaces 1*a* and 1*b* of the chassis 1 are provided with support holes 1*c* for rotatably supporting the support rod 5 respectively. An ink sheet receiving hole 1*d* is provided on the second side surface 1*b* of the chassis 1, for receiving an ink sheet (not shown). The two platen roller bearings 4 are mounted on the first and second side surfaces 1*a* and 1*b* of the chassis 1 respectively, for rotatably supporting the platen roller 3.

Figure 3:
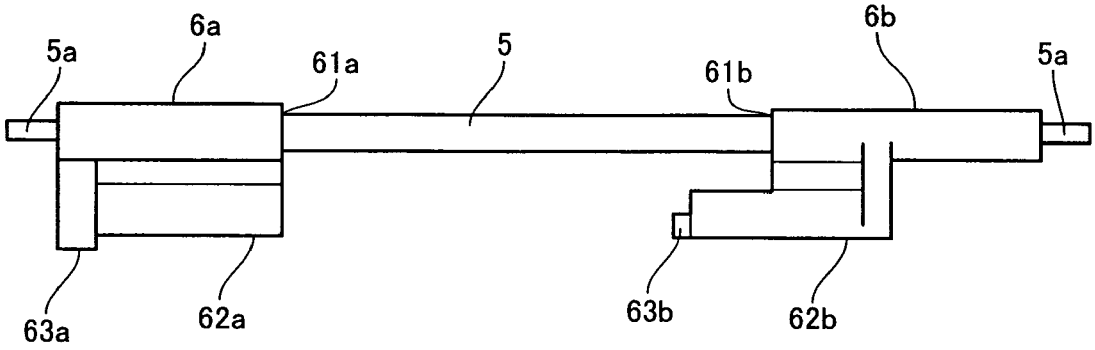
FIG. 3 is a front elevational view showing a head portion pressing member and a shaft of the thermal transfer printer according to the embodiment shown in FIG. 1.
Figure 4:
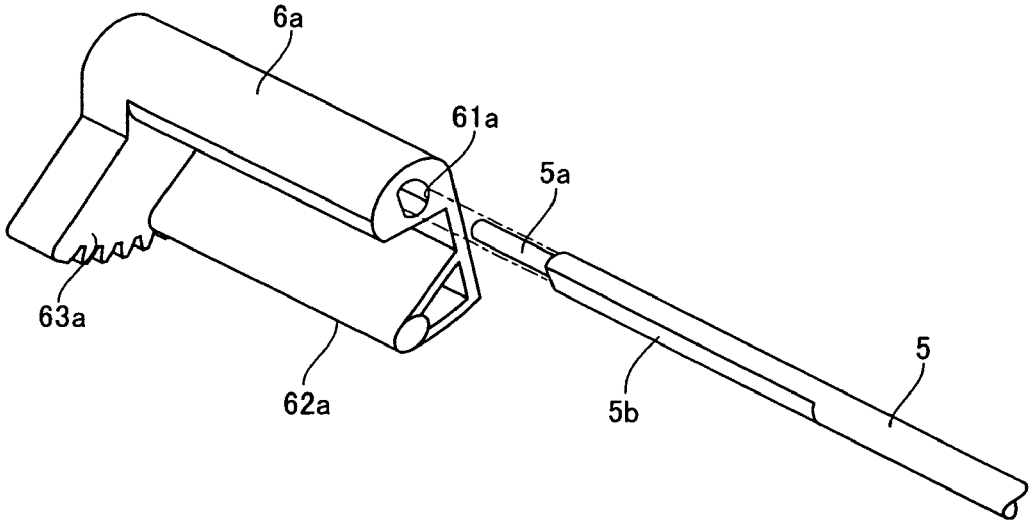
FIGS. 4 and 5 are perspective views for illustrating the mounting structures of the head portion pressing member and the shaft of the thermal transfer printer according to the embodiment shown in FIG. 1.
Figure 5:
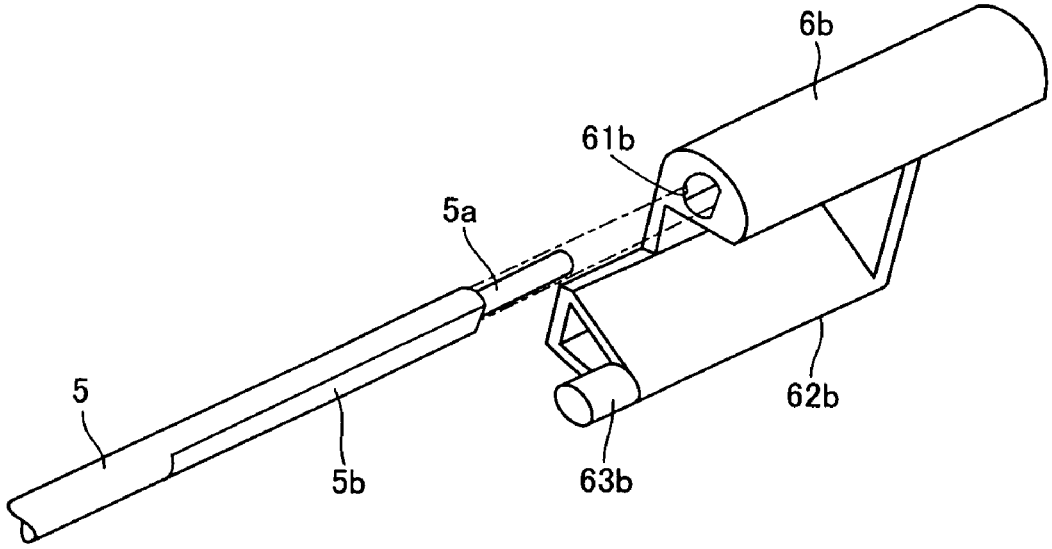

Support portions 5*a* are provided on both ends of the support rod 5 respectively. The support portions 5*a* of the support rod 5 are fitted into the support holes 1*c* provided on the first and second side surfaces 1*a* and 1*b* of the chassis 1 respectively. As shown in FIG. 3, head portion pressing members 6*a* and 6*b* are mounted on both ends of the support rod 5 respectively in an unidling manner. More specifically, D-shaped insert portions 5*b* are provided around both ends of the support rod 5 respectively, as shown in FIGS. 4 and 5. The two head portion pressing members 6*a* and 6*b* are formed with D-shaped receiving holes 61*a* and 61*b* receiving the insert portions 5*b* provided around both ends of the support rod 5 respectively. Thus, the support rod 5 as well as the second head portion pressing member 6*b* rotate upon rotation of the first head portion pressing member 6*a*. The head portion pressing members 6*a* and 6*b* are arranged on the first and second side surfaces 1*a* and 1*b* of the chassis 1 respectively, as shown in FIGS. 1 and 2.

According to this embodiment, the first head portion pressing member 6*a* is integrally formed with a pressing portion 62*a* and a gear portion 63*a*, as shown in FIG. 4. The second head portion pressing member 6*b* is integrally formed with a pressing portion 62*b* and a protrusion 63*b* protruding from the pressing portion 62*b* in the extensional direction of the support rod 5, as shown in FIG. 5. The protrusion 63*b* is an example of the "first engaging portion" in the present invention.

Figure 6:
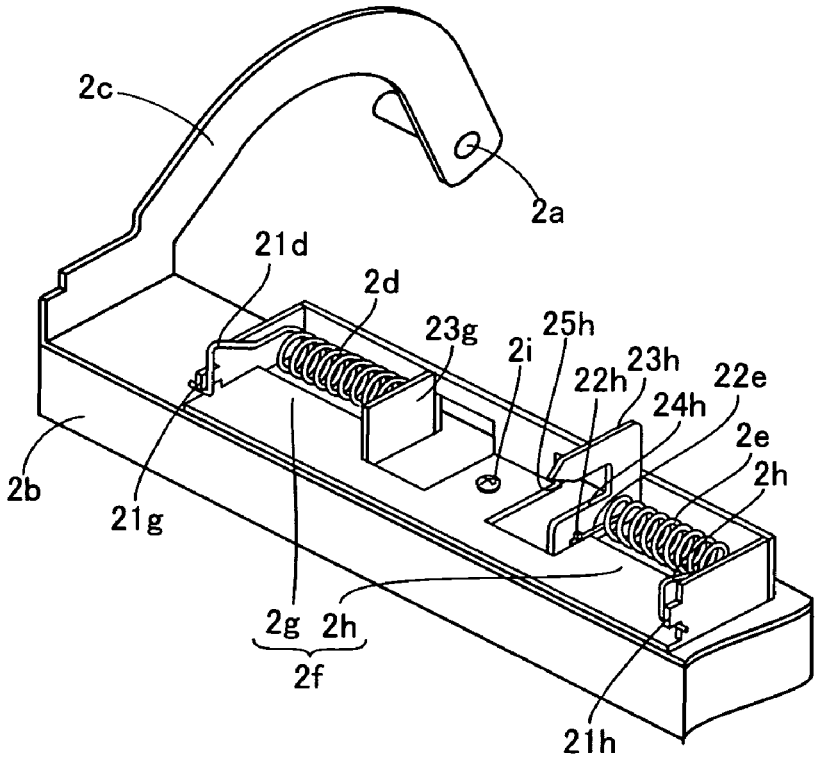
FIGS. 6 and 7 are perspective views showing the structure of a print head of the thermal transfer printer according to the embodiment shown in FIG. 1.
Figure 7:
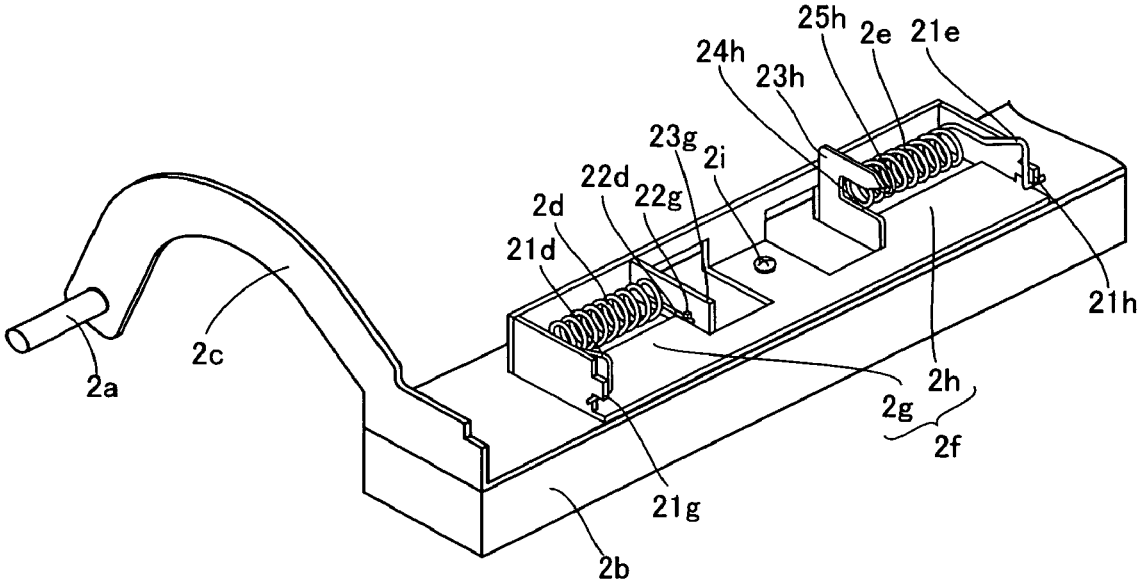

As shown in FIGS. 6 and 7, the print head 2 has a pair of support shafts 2*a*, a head portion 2*b* opposed to the platen roller 3 (see FIGS. 1 and 2) and a pair of arms 2*c* coupling the support shafts 2*a* and the head portion 2*b* with each other. This print head 2 is rotatable about the support shafts 2*a*. In other words, the pair of support shafts 2*a* of the print head 2 are rotatably mounted on the first and second side surfaces 1*a* and 1*b* of the chassis 1 respectively.

According to this embodiment, first and second torsion coil springs 2*d* and 2*e* for urging the head portion 2*b* toward the platen roller 3 (see FIGS. 1 and 2) are arranged on the upper portion of the head portion 2*b* in regions corresponding to the first and second head portion pressing members 6*a* and 6*b* (see FIGS. 1 and 2) respectively. More specifically, a metal spring fixing member 2*f* formed by a plate body consisting of first and second spring fixing portions 2*g* and 2*h* is mounted on the upper portion of the head portion 2*b* with a screw 2*i*. The first and second spring fixing portions 2*g* and 2*h* of the spring fixing member 2*f* are arranged in the axial direction of the platen roller 3 at a prescribed interval. The first and second spring fixing portions 2*g* and 2*h* are formed with an uprighted spring fixing section 23*g* and an upright wall-shaped engaging portion 23*h*, also serving as a spring fixing section, opposed to each other respectively. The first and second torsion coil springs 2*d* and 2*e* are fixed to the first and second spring fixing portions 2*g* and 2*h* of the spring fixing member 2*f* respectively. The first spring fixing portion 2*g* of the spring fixing member 2*f* is provided with a stop portion 21*g* and a protrusion 22*g*, as shown in FIGS. 6 and 7. The second spring fixing portion 2*h* of the spring fixing member 2*f* is also provided with a stop portion 21*h* and a protrusion 22*h*. The first torsion coil spring 2*d* is an example of the "first spring member" in the present invention, and the second torsion coil spring 2*e* is an example of the "second spring member" in the present invention.

According to this embodiment, the first torsion coil spring 2*d* has a first end 21*d* pressed by the pressing portion 62*a* of the first head portion pressing member 6*a* upon downward rotation of the first head portion pressing member 6*a* and a second end 22*d* transmitting urging force resulting from the pressed first end 21*d* to the head portion 2*b*, as shown in FIGS. 2, 6 and 7. The second torsion coil spring 2*e* has a first end 21*e* pressed by the pressing portion 62*b* of the second head portion pressing member 6*b* upon downward rotation of the second head portion pressing member 6*b* and a second end 22*e* transmitting urging force resulting from the pressed first end 21*e* to the head portion 2*b*. The head portion 2*b* is pressed against the platen roller 3 due to the urging force transmitted thereto from the torsion coil springs 2*d* and 2*e*. The first end 21*d* of the first torsion coil spring 2*d* is stopped on the stop portion 21*g* of the spring fixing member 2*f*, while the second end 22*d* thereof is fixed to the protrusion 22*g* of the spring fixing member 2*f*. The first end 21*e* of the second torsion coil spring 2*e* is stopped on the stop portion 21*h* of the spring fixing member 2*f*, while the second end 22*e* thereof is fixed to the protrusion 22*h* of the spring fixing member 2*f*.

Figure 8:
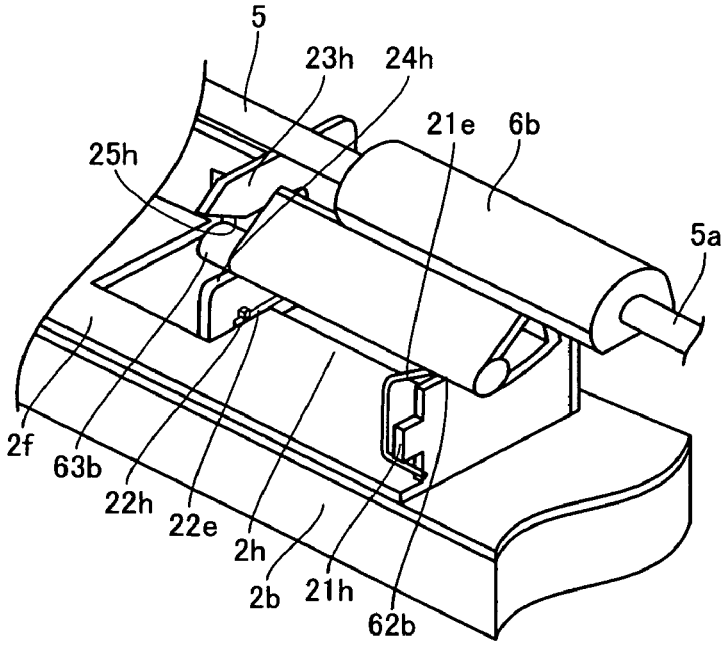
FIG. 8 is an enlarged detailed diagram of the head portion pressing member of the thermal transfer printer according to the embodiment shown in FIG. 1.

According to this embodiment, the engaging portion 23*h* having a notch 24*h* engaging with the protrusion 63*b* of the second head portion pressing member 6*b* is integrally formed on the second spring fixing portion 2*h* of the spring fixing member 2*f* by partially uprighting the spring fixing member 2*f*, as shown in FIG. 8. Thus, the protrusion 63*b* of the second head portion pressing member 6*b* and the notch 24*h* of the second spring fixing portion 2*h* engage with each other upon upward rotation of the second head portion pressing member 6*b*, thereby upwardly rotating the head portion 2*b*. Consequently, the head portion 2*b* having been pressed against the platen roller 3 (see FIGS. 1 and 2) is separated from the platen roller 3 upon rotation of the second head portion pressing member 6*b*. A chamfer 25*h* is formed on the opening side of the notch 24*h*, in order to simplify the engagement with the protrusion 63*b*. The engaging portion 23*h* is an example of the "second engaging portion" in the present invention.

According to this embodiment, the drive gear 7 and the intermediate gear 10 are provided for rotating the head portion pressing members 6*a* and 6*b* by transmitting driving force of the motor 8 thereto, as shown in FIGS. 1 and 2. The drive gear 7 and the intermediate gear 10 are mounted only on the first side surface 1*a* of the chassis 1. The motor 8 is mounted on the first side surface 1*a* of the chassis 1 through the motor bracket 9. A small diameter gear portion 7*a* of the drive gear 7 meshes with the gear portion 63*a* of the first head portion pressing member 6*a*, while a large diameter gear portion 7*b* of the drive gear 7 meshes with a small diameter gear 10*a* of the intermediate gear 10. A large diameter gear 10*b* of the intermediate gear 10 meshes with a motor gear 8*a* of the motor 8. Thus, driving of the motor 8 is transmitted to the first head portion pressing member 6*a* through the intermediate gear 10 and the drive gear 7.

Operations of the thermal transfer printer according to this embodiment for pressing the print head 2, separated from the platen roller 3, against the platen roller 3 are now described with reference to FIGS. 2 and 9 to 14.

Figure 9:
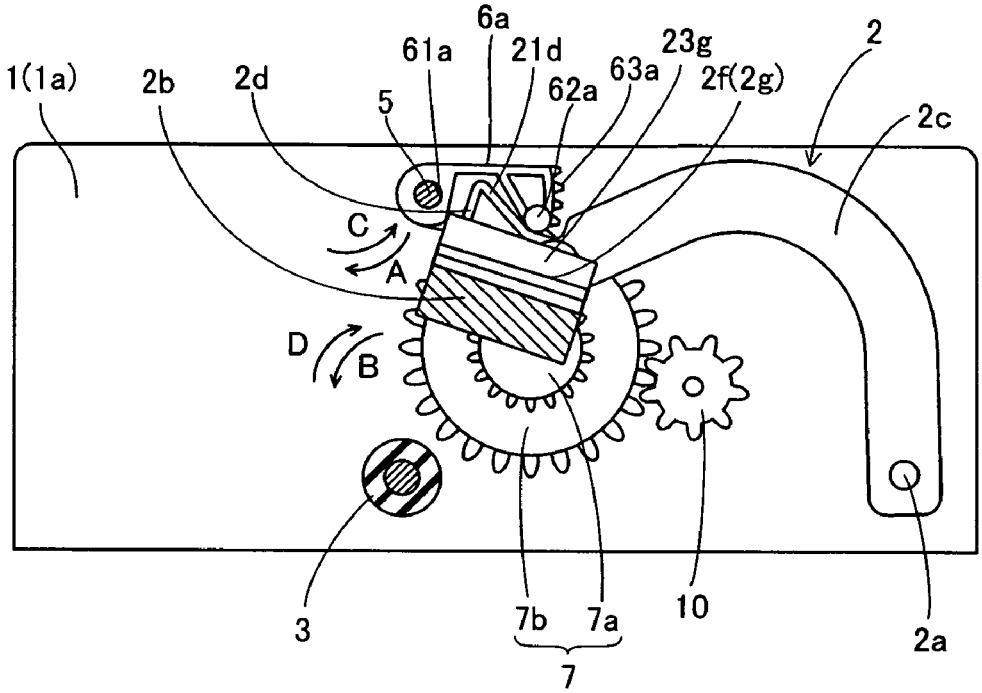
FIGS. 9 to 14 are sectional views for illustrating operations for pressing and separating the print head against and from the platen roller in the thermal transfer printer according to the embodiment shown in FIG. 1.
Figure 10:
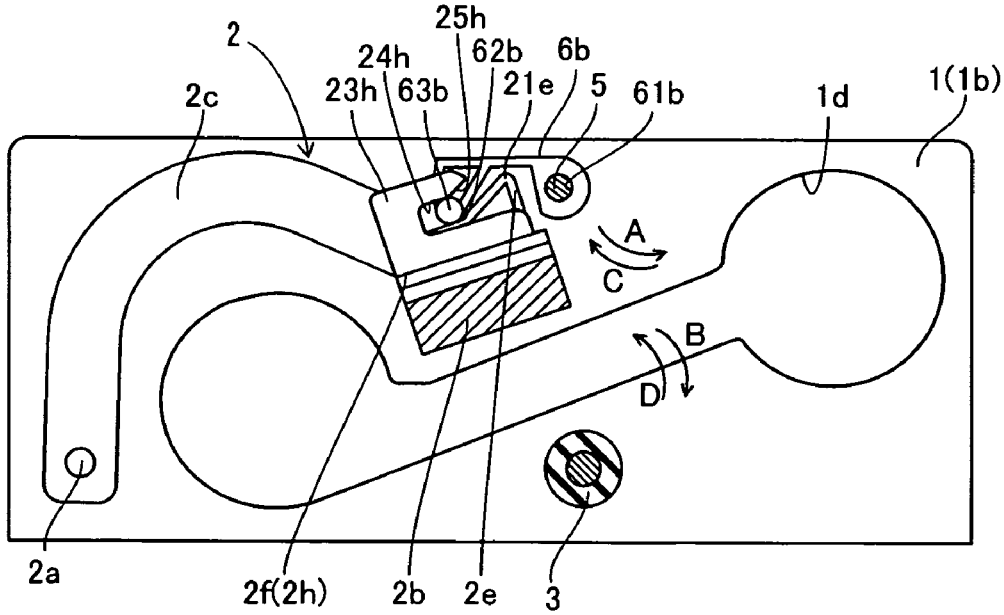

In an initial state, the head portion 2*b* of the print head 2 is held on a spaced position with respect to the platen roller 3, as shown in FIGS. 9 and 10. At this time, the protrusion 63*b* of the second head portion pressing member 6*b* engages with the notch 24*h* of the engaging portion 23*h* of the second spring fixing portion 2*h* provided on the upper portion of the head portion 2*b* as shown in FIG. 10, thereby restraining the head portion 2*b* from rotation along arrow B in FIG. 10.

Figure 11:
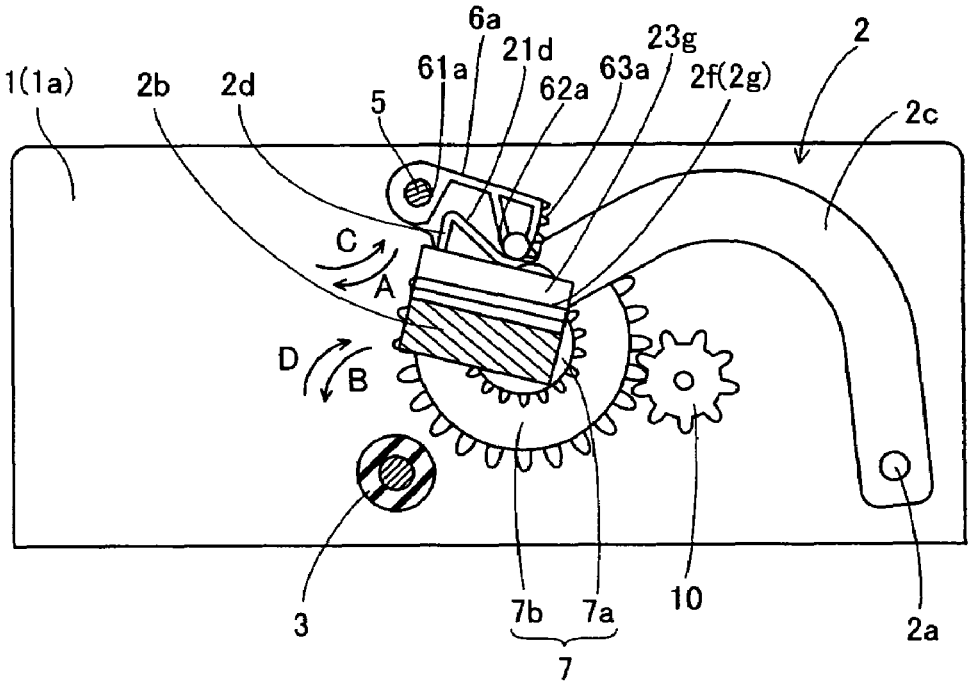
Figure 13:
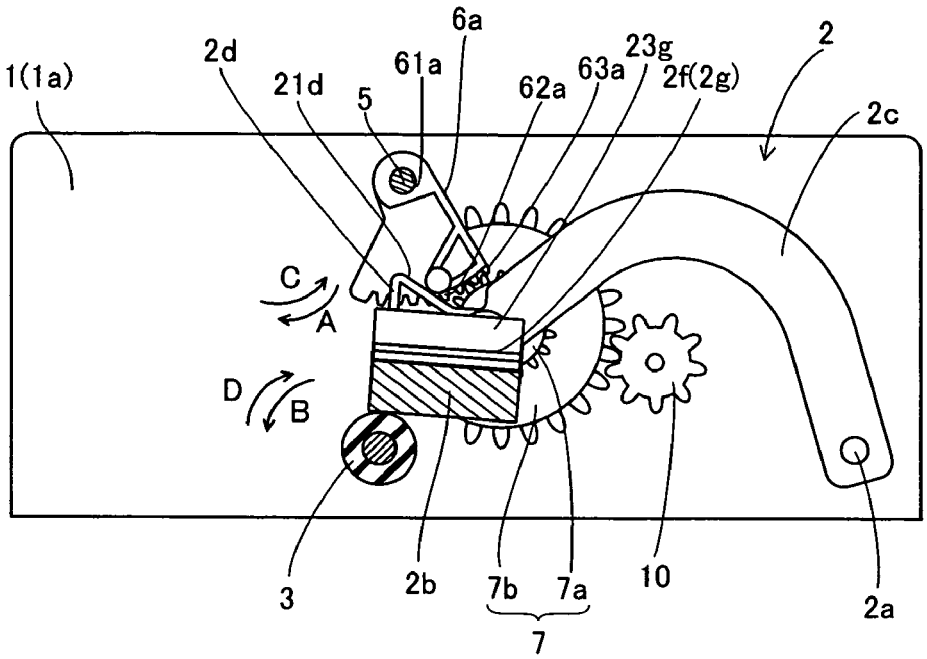
Figure 14:
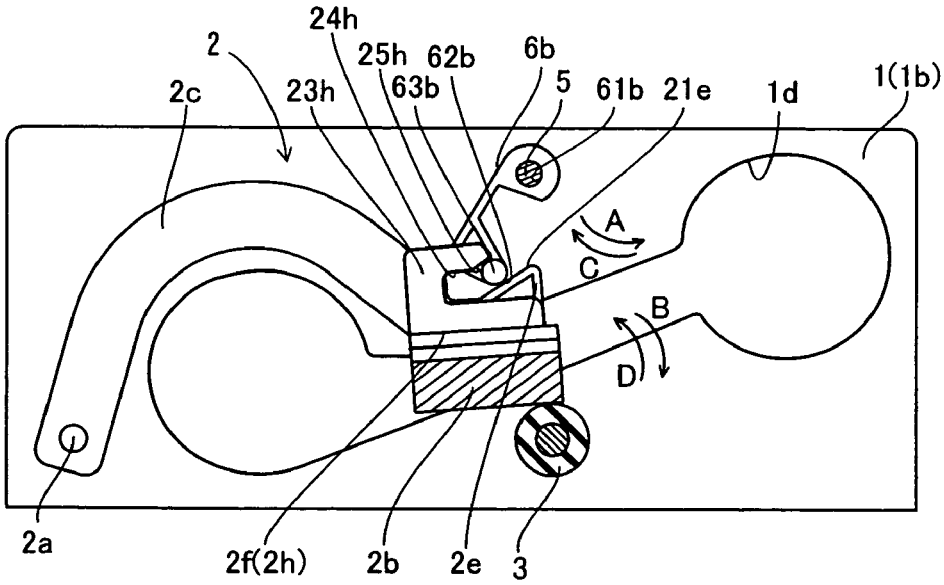

When the motor 8 (see FIG. 2) is driven from the initial state shown in FIGS. 9 and 10, the driving force of the motor 8 is transmitted to the gear portion 63*a* of the first head portion pressing member 6*a* through the intermediate gear 10 and the drive gear 7, thereby rotating the first head portion pressing member 6*a* about the support rod 5 along arrow A as shown in FIG. 11. At this time, the first and second head portion pressing members 6*a* and 6*b* (see FIG. 2) remain unidling with respect to the support rod 5, whereby the second head portion pressing member 6*b* is also rotated along arrow A. The head portion 2*b*, having been restrained from rotating along arrow B by the protrusion 63*b*, is also rotated along arrow B due to rotation of the protrusion 63*b* of the second head portion pressing member 6*b* along arrow A. Thus, the head portion 2*b* is moved toward the platen roller 3 (press side), as shown in FIGS. 13 and 14. The direction of arrow A is an example of the "first direction" in the present invention.

In this state where the print head 2 is moved toward the platen roller 3, the head portion pressing members 6*a* and 6*b* are further rotated along arrow A. Thus, the pressing portion 62*a* of the first head portion pressing member 6*a* presses the first end 21*d* of the first torsion coil spring 2*d* of the print head 2. Further, the pressing portion 62*b* of the second head portion pressing member 6*b* presses the first end 21*e* of the second torsion coil spring 2*e* of the print head 2. At this time, urging force is generated in the torsion coil springs 2*d* and 2*e* and transmitted to the head portion 2*b* through the second ends 22*d* and 22*e* of the torsion coil springs 2*d* and 2*e*. Thus, the head portion 2*b* is urged toward the platen roller 3. In this state, the engagement between the protrusion 63*b* of the second head portion pressing member 6*b* and the notch 24*h* of the engaging portion 23*h* of the spring fixing member 2*f* is canceled.

Operations of separating the print head 2 of the thermal transfer printer according to this embodiment from the platen roller 3 are now described with reference to FIGS. 9 to 14.

As shown in FIGS. 13 and 14, the head portion 2*b* is in the state urged toward the platen roller 3. From the state shown in FIG. 13, the motor 8 (see FIG. 2) is so driven that the driving force thereof is transmitted to the gear portion 63*a* of the first head portion pressing member 6*a* through the intermediate gear 10 and the drive gear 7, thereby rotating the first head portion pressing member 6*a* about the support rod 5 along arrow C in FIG. 13. At this time, the first and second head portion pressing members 6*a* and 6*b* (see FIG. 2) remain unidling with respect to the support rod 5, whereby the second head portion pressing member 6*b* is also rotated along arrow C in FIG. 14. Thus, the head portion 2*b* is released from the force urging the same toward the platen roller 3 through the torsion coil springs 2*d* and 2*e* pressed by the head portion pressing members 6*a* and 6*b*. The protrusion 63*b* of the second head portion pressing member 6*b* engages with the notch

24*h* of the engaging portion 23*h* of the second spring fixing portion 2*h* of the spring fixing member 2*f* mounted on the head portion 2*b*. The direction of arrow C is an example of the "second direction" in the present invention.

Figure 12:
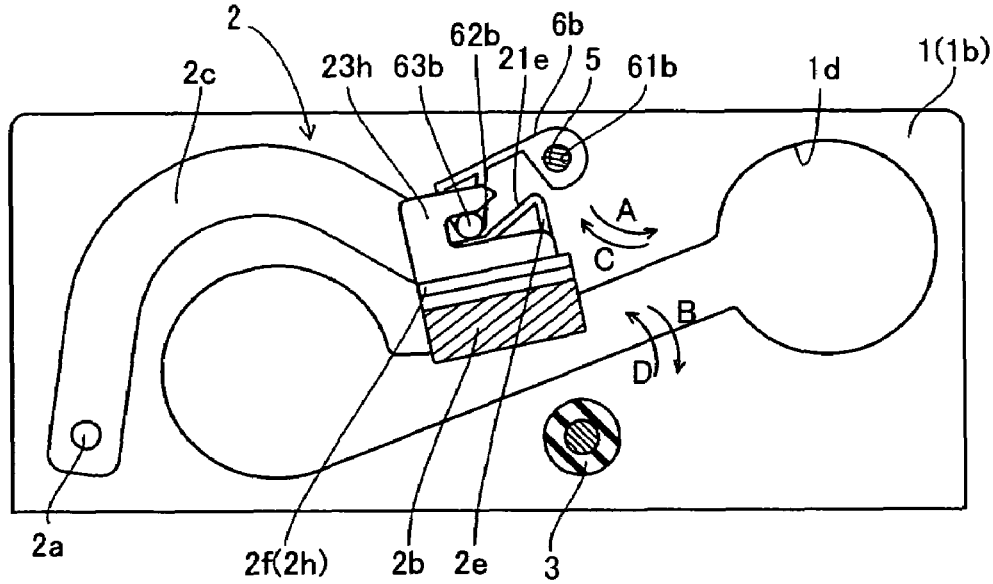

When the head portion pressing members 6*a* and 6*b* are further rotated along arrow C in FIG. 14, the print head 2 is also lifted up and rotated along arrow D in FIG. 12 following this rotation of the head portion pressing members 6*a* and 6*b* along arrow C in FIG. 14, due to the engagement between the protrusion 63*b* of the second head portion pressing member 6*b* and the notch 24*h* of the engaging portion 23*h* of the spring fixing member 2*f* mounted on the head portion 2*b*. Thus, the head portion 2*b* is separated from the platen roller 3. The head portion pressing members 6*a* and 6*b* are further rotated along arrow C so that the print head 2 is also rotated along arrow D and moved to the spaced position with respect to the platen roller 3, as shown in FIG. 10. This spaced position of the print head 2 corresponds to the initial state of the operation of pressing the head portion 2*b* against the platen roller 3. Thus, the print head 2 is moved from the position urged toward the platen roller 3 (see FIG. 14) to the spaced position where the head portion 2*b* is separated from the platen roller 3 (see FIG. 10).

According to this embodiment, as hereinabove described, the drive gear 7 is arranged on the first end of the support rod 5 for rotating the head portion pressing members 6*a* and 6*b* mounted on the support rod 5 by transmitting the driving force of the motor 8 thereto and the gear portion 63*a* meshing with the drive gear 7 is formed on the first head portion pressing member 6*a* so that the driving force of the motor 8 can be transmitted to the head portion pressing members 6*a* and 6*b* through the drive gear 7, whereby the upper portion of the head portion 2*b* of the print head 2 can be pressed with the head portion pressing members 6*a* and 6*b* by rotating the same through the support rod 5. When the head portion pressing members 6*a* and 6*b* are arranged on positions uniformizing pressing force against the print head 2, therefore, the print head 2 can be uniformly pressed against the platen roller 3 with the head portion pressing members 6*a* and 6*b* through the support rod 5 with the gear portion 63*a* arranged on the first end of the support rod 5, whereby the thermal transfer printer can be inhibited from applying nonuniform pressing force against the print head 2 although the drive gear 7 is not arranged on each end of the support rod 5. Thus, the drive gear 7 for rotating the head portion pressing members 6*a* and 6*b* may not be arranged on each side of the support rod 5, whereby the number of components can be reduced.

According to this embodiment, the second head portion pressing member 6*b* is provided with the protrusion protruding in the extensional direction of the support rod 5 while the second spring fixing portion 2*h* of the spring fixing member 2*f* mounted on the head portion 2*b* of the print head 2 is provided with the notch 24*h* engaging with the protrusion 63*b* of the second head portion pressing member 6*b* upon upward rotation of the second head portion pressing member 6*b* so that the head portion 2*b* of the print head 2 can be upwardly rotated due to the engagement between the notch 24*h* of the second spring fixing portion 2*h* of the spring fixing member 2*f* mounted on the head portion 2*b* of the print head 2 and the protrusion 63*b* of the second head portion pressing member 6*b* upon upward rotation of the second head portion pressing member 6*b*, whereby the head portion 2*b* of the print head 2 can be separated from the platen roller 3 through the upward rotation of the second head portion pressing member 6*b*. Thus, no mechanical portion may be additionally provided for separating the head portion 2*b* of the print head 2 from the platen roller 3, whereby the number of components can be reduced also according to this structure.

According to this embodiment, the drive gear 7 for rotating the head portion pressing members 6*a* and 6*b* mounted on the support rod 5 may not be arranged on each end of the support rod 5 and no mechanical portion may be additionally provided for separating the head portion 2*b* of the print head 2 from the platen roller 3, whereby the thermal transfer printer can be downsized.

According to this embodiment, the spring fixing member 2*f* having the first and second spring fixing portions 2*g* and 2*h* arranged in the extensional direction of the platen roller 3 at the prescribed interval is mounted on the head portion 2*b* of the print head 2 while the first and second torsion coil springs 2*d* and 2*e* urging the head portion 2*b* toward the platen roller 3 are fixed to the first and second spring fixing portions 2*g* and 2*h* of the spring fixing member 2*f* respectively for generating urging force in the first torsion coil spring 2*d* by pressing the same with the first head portion pressing member 6*a* rotated following driving of the drive gear 7 and generating urging force in the second torsion coil spring 2*e* by pressing the same with the second head portion pressing member 6*b* corotating with the first head portion pressing member 6*a*, whereby the print head 2 can be urged toward the platen roller 3 with the two torsion coil springs 2*d* and 2*e*. Thus, the head portion 2*b* of the print head 2 can be stably pressed against the platen roller 3 as compared with a case of urging the head portion 2*b* of the print head 2 toward the platen roller 3 with urging force of a single spring member.

According to this embodiment, the gear portion 63*a* meshing with the drive gear 7 is so integrally provided on the first head portion pressing member 6*a* that the number of components can be inhibited from increase despite the gear portion 63*a* provided on the first head portion pressing member 6*a*.

According to this embodiment, the protrusion 63*b* protruding in the extensional direction of the support rod 5 is integrally provided on the second head portion pressing member 6*b* while the engaging portion 23*h* including the notch 24*h* engaging with the protrusion 63*b* of the second head portion pressing member 6*b* is integrally provided on the second spring fixing portion 2*h* of the spring fixing member 2*f*, whereby the number of components can be inhibited from increase despite the protrusion 63*b* and the engaging portion 23*h* including the notch 24*h* provided on the second head portion pressing member 6*b* and the second spring fixing portion 2*h* of the spring fixing member 2*f* respectively.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment of the present invention is applied to the thermal transfer printer, the present invention is not restricted to this but is also applicable to another image generating apparatus other than the thermal transfer printer.

While the second head portion pressing member is formed with the protrusion and the second spring fixing portion of the spring fixing member provided on the upper portion of the head portion is formed with the engaging portion including the notch engaging with the protrusion in the aforementioned embodiment, the present invention is not restricted to this but the first head portion pressing member may alternatively be formed with a protrusion so that the first spring fixing portion of the spring fixing member provided on the upper portion of the head portion is formed with an engaging portion including a notch engaging with the protrusion.

While the head portion pressing member is formed with the protrusion and the spring fixing member is provided with the engaging portion including the notch engaging with the protrusion in the aforementioned embodiment, the present invention is not restricted to this but a member other than the head portion pressing member corotating with the head portion pressing member may alternatively be formed with a protrusion so that another member other than the spring fixing member of the head portion is formed with an engaging portion including a notch engaging with this protrusion.

While the two torsion coil springs are pressed with the two head portion pressing members while the head portion of the print head is urged toward the platen roller with the urging force generated in the two torsion coil springs in the aforementioned embodiment, the present invention is not restricted to this but a single torsion coil spring may alternatively be pressed with a single head portion pressing member for urging the head portion of the print head toward the platen roller with urging force generated in the single torsion coil spring. Further alternatively, at least three torsion coil springs may be pressed with at least three head portion pressing members respectively for urging the head portion of the print head toward the platen roller with urging force generated in at least three torsion coil springs.

While the gear portion is integrally provided on the first head portion pressing member for rotating the head portion pressing member by transmitting the driving force of the motor to the gear portion in the aforementioned embodiment, the present invention is not restricted to this but a gear portion may alternatively be provided independently of the head portion pressing member for rotating the head portion pressing member by transmitting the driving force of the motor to the independently provided gear portion.

While the engaging portion including the notch engaging with the protrusion of the second head portion pressing member is integrally formed on the spring fixing member in the aforementioned embodiment, the present invention is not restricted to this but the engaging portion may alternatively be provided on another member including a notch, other than the spring fixing member, constituting the print head. Further alternatively, a single engaging member including a notch may be mounted on the print head.

What is claimed is:

1. An image generating apparatus comprising:

a platen roller;

a print head, opposed to said platen roller, having a head portion pressed against said platen roller;

a head portion pressing member consisting of one or more members provided independently of said print head and mounted on a rotary shaft for pressing said head portion of said print head against said platen roller; and a gear for rotating said head portion, wherein at least one member of said head portion pressing member is provided with a gear portion meshing with said gear, and at least one member of said head portion pressing member is provided with a first engaging portion, and said head portion is provided with a second engaging portion engaging with said first engaging portion of said head portion pressing member upon upward rotation of said head portion pressing member.

2. The image generating apparatus according to claim 1, wherein said print head includes a spring fixing member, mounted on said head portion, having a first spring fixing portion and a second spring fixing portion arranged in the axial direction of said platen roller at a prescribed interval as well as a first spring member and a second spring member fixed to said first spring fixing portion and said second spring fixing portion of said spring fixing member respectively for urging said head portion toward said platen roller, and said head portion pressing member includes a first head portion pressing member for generating urging force in said spring member by pressing said first spring member through rotation following driving of said gear and a second head portion pressing member for generating urging force in said second spring member by pressing said second spring member through corotation with said first head portion pressing member.

3. The image generating apparatus according to claim 2, wherein said first head portion pressing member is integrally provided with said gear portion meshing with said gear.

4. The image generating apparatus according to claim 2, wherein said first engaging portion is provided on either said first head portion pressing member or said second head portion pressing member, and said second engaging portion is provided on either said first spring fixing portion or said second spring fixing portion corresponding to said first or second head portion pressing member provided with said first engaging portion.

5. The image generating apparatus according to claim 4, wherein said first engaging portion includes a protrusion integrally provided on said second head portion pressing member to protrude in the extensional direction of said rotary shaft, and said second engaging portion includes a notch integrally provided on said second spring fixing portion of said spring fixing member for engaging with said protrusion of said second head portion pressing member upon upward rotation of said second head portion pressing member.

6. The image generating apparatus according to claim 5, wherein said second spring fixing portion includes an upright wall formed by partially uprighting said spring fixing member formed by a plate body, and said notch is formed on said upright wall.

7. The image generating apparatus according to claim 4, wherein a chamfer is formed on the opening side of said notch.

8. The image generating apparatus according to claim 2, wherein said first head portion pressing member and said second head portion pressing member press said first spring member and said second spring member respectively while the engagement between said first engaging portion and said second engaging portion is canceled.

9. The image generating apparatus according to claim 2, wherein said first spring member and said second spring member are torsion coil springs.

10. The image generating apparatus according to claim 1, wherein said print head further includes a support shaft and an arm coupling said support shaft and said head portion with each other and is rotatable about said support shaft, said head portion pressing member rotates in a first direction thereby rotating said print head for pressing and moving said head portion toward said platen roller in printing, and said head portion pressing member rotates in a second direction opposite to said first direction upon engagement between said first engaging portion and said second engaging portion thereby rotating said print head for separating said head portion from said platen roller in nonprinting.

11. An image generating apparatus comprising:

a platen roller;

a print head, opposed to said platen roller, having a head portion pressed against said platen roller;

a head portion pressing member provided independently of said print head and mounted on a rotary shaft for pressing said head portion of said print head against said platen roller; and a gear for rotating said head portion by transmitting driving force of a motor to said head portion pressing member, wherein said print head further includes a spring fixing member, mounted on said head portion, having a first spring fixing portion and a second spring fixing portion arranged in the axial direction of said platen roller at a prescribed interval as well as a first spring member and a second spring member fixed to said first spring fixing portion and said second spring fixing portion of said spring fixing member respectively for urging said head portion toward said platen roller, said head portion pressing member further includes a first head portion pressing member for generating urging force in said spring member by pressing said first spring member through rotation following driving of said gear and a second head portion pressing member for generating urging force in said second spring member by pressing said second spring member through corotation with said first head portion pressing member, at least one member of said first head portion pressing member is integrally provided with a gear portion meshing with said gear, and at least one member of said head portion pressing member is provided with a first engaging portion, and said second head portion pressing member is integrally provided with a protrusion protruding in the extensional direction of said rotary shaft while said second spring fixing portion of said spring fixing member is integrally provided with a notch engaging with said protrusion of said second head portion pressing member upon upward rotation of said second head portion pressing member.

12. The image generating apparatus according to claim 11, wherein said first engaging portion is provided on either said first head portion pressing member or said second head portion pressing member, and said second engaging portion is provided on either said first spring fixing portion or said second spring fixing portion corresponding to said first or second head portion pressing member provided with said first engaging portion.

13. The image generating apparatus according to claim 11, wherein said second spring fixing portion includes an upright wall formed by partially uprighting said spring fixing member formed by a plate body, and said notch is formed on said upright wall.

14. The image generating apparatus according to claim 11, wherein a chamfer is formed on the opening side of said notch.

15. The image generating apparatus according to claim 11, wherein said first head portion pressing member and said second head portion pressing member press said first spring member and said second spring member respectively while the engagement between said first engaging portion and said second engaging portion is canceled.

16. The image generating apparatus according to claim 11, wherein said first spring member and said second spring member are torsion coil springs.

17. The image generating apparatus according to claim 11, wherein said print head further includes a support shaft and an arm coupling said support shaft and said head portion with each other and is rotatable about said support shaft, said head portion pressing member rotates in a first direction thereby rotating said print head for pressing and moving said head portion toward said platen roller in printing, and said head portion pressing member rotates in a second direction opposite to said first direction upon engagement between said first engaging portion and said second engaging portion thereby rotating said print head for separating said head portion from said platen roller in nonprinting.

* * * * *